United States Patent [19]

Mabuchi

[11] Patent Number: 4,536,734

[45] Date of Patent: Aug. 20, 1985

[54] TRANSFORMER WINDING SHEET INSULATOR WITH SPACER MEMBER

[75] Inventor: Sadaaki Mabuchi, Aichi, Japan

[73] Assignee: Tokyo Shibaura Denki Kabushiki Kaisha, Kawasaki, Japan

[21] Appl. No.: 566,897

[22] Filed: Dec. 29, 1983

[30] Foreign Application Priority Data

Jun. 10, 1983 [JP] Japan ..... 58-88600[U]

[51] Int. Cl.[3] ..... H01F 27/26; H01F 27/30

[52] U.S. Cl. ..... 336/196; 336/209; 336/210

[58] Field of Search ..... 336/209, 210, 198, 196, 336/206, 60, 185; 310/215

[56] References Cited

U.S. PATENT DOCUMENTS

| | | | |
|---|---|---|---|
| 830,419 | 9/1906 | Downes | 336/209 X |
| 1,797,768 | 3/1931 | Goad | 336/209 |
| 2,511,174 | 6/1950 | Osborne | 336/209 X |
| 2,749,525 | 6/1956 | Henderson | 336/209 |
| 2,858,514 | 10/1958 | Henderson et al. | 336/209 |
| 3,317,875 | 5/1967 | Williams | 336/198 |
| 3,378,800 | 4/1968 | Liberman | 336/209 X |
| 4,160,967 | 7/1979 | Beech | 336/209 |
| 4,222,023 | 9/1980 | Beech | 336/209 |

FOREIGN PATENT DOCUMENTS

| | | |
|---|---|---|
| 49-132421 | 3/1948 | Japan . |
| 57-50826 | 3/1982 | Japan . |

*Primary Examiner*—Thomas J. Kozma

*Attorney, Agent, or Firm*—Schwartz, Jeffery, Schwaab, Mack, Blumenthal & Evans

[57] ABSTRACT

A transformer with E-shaped and I-shaped magnetic cores which are respectively formed of a stack of E-shaped sheet laminations and a stack of I-shaped sheet laminations, includes sheet insulators to insulate coils from the magnetic core. Spacer members are formed from parts of the sheet insulator to hold the preferable distance between the coil and a central leg of the E-shaped magnetic core. The spacer members are each formed by folding parts of the sheet insulator.

6 Claims, 3 Drawing Figures

TRANSFORMER WINDING SHEET INSULATOR WITH SPACER MEMBER

BACKGROUND OF THE INVENTION

This invention relates to a transformer construction with E-shaped and I-shaped magnetic cores and in particular to spacer members for a transformer, and to a method of manufacturing the transformer.

A conventional transformer with E-shaped and I-shaped magnetic cores comprises an E-shaped magnetic core, an I-shaped magnetic core, primary and secondary coils, sheet insulators for insulating the coils from the cores, and spacer members for fixing the coils to the magnetic cores. The E-shaped magnetic core is formed from a stack of E-shaped laminations of magnetic material, and the I-shaped magnetic core is formed of I-shaped sheet laminations of magnetic material. The transformer of the above type is used, for example, for a high voltage transformer of a microwave oven. The sheet insulators cover the primary and secondary coils respectively. The spacer members, which are made of plastic for instance, are inserted into a gap defined between the coils and the cores to maintain the preferable distance after the sheet insulators are placed on the coils and after the coils are disposed on the cores.

The coils may be disposed in a predetermined position with respect to the magnetic cores. The spacer members also prevent the E-shaped sheet laminations from expanding, because the inner leg stack of the E-shaped core is not welded together.

However, if one side of the gap is larger than the other side because of shifting of the coils, it is difficult in practice for the spacer members to hold the coil in a preferable or desired position for a long period of time and completely avoid expansion of the E-shaped sheet laminations inasmuch as the spacer members are inserted into the gap after the disposition of the coils. Therefore, in such prior art arrangements, vibrations of the laminations of the inner leg causes undesirable noise.

SUMMARY OF THE INVENTION

It is accordingly an object of the invention to provide a transformer construction with E-shaped and I-shaped magnetic cores which includes new and improved spacer members.

It is another object of the invention to provide a transformer in which the spacer members can more precisely maintain the preferable distance between the coils and an inner leg of the E-shaped magnetic core.

It is yet another object of the invention to provide a transformer in which the spacer members can prevent the stack of laminations of the inner leg from expanding in the stacking direction.

It is a further object of the invention to provide a mechanically simple and inexpensive method of manufacturing a transformer.

To accomplish the foregoing and other objects in accordance with a preferred embodiment of the invention, a transformer comprises an E-shaped magnetic core formed of a stack of E-shaped sheet laminations which has three parallel legs and a heel member joining the legs at their one end, an I-shaped magnetic core formed of a stack of I-shaped sheet laminations which is disposed in parallel with the heel member at the opposite ends of the legs, primary and secondary coils which are wound around an inner leg of the three parallel legs, sheet insulators for covering the coils respectively so that the coils are preferably insulated from the cores, and spacer members formed by folding parts of the sheet insulator and disposed between the coil and the inner leg, which hold the preferable distance between the coil and the leg and prevent the stack of laminations of the inner parallel leg from expanding in the stacking direction. Preferably, the spacer members each have a portion thereof folded over itself in an accordion-like fashion to provide a bias between the coils and the core.

BRIEF DESCRIPTION OF THE DRAWINGS

Features of the present invention will be apparent from the following drawings, in which.

DESCRIPTION OF THE PREFERRED EMBODIMENT

Figure 1:
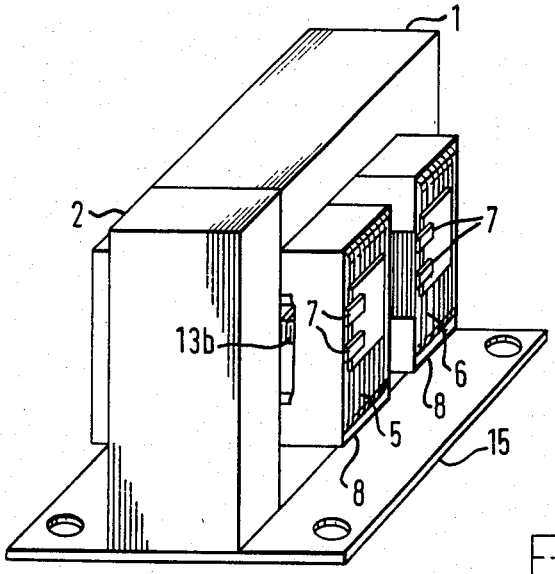
FIG. 1 is a perspective view of a transformer of the invention.
Figure 3:
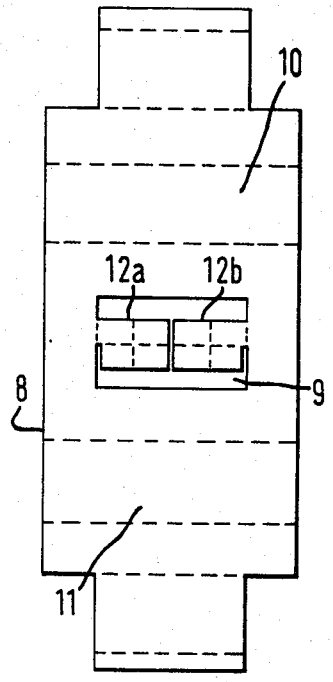
FIG. 3 is a development view of a sheet insulator of the invention.
Figure 2:
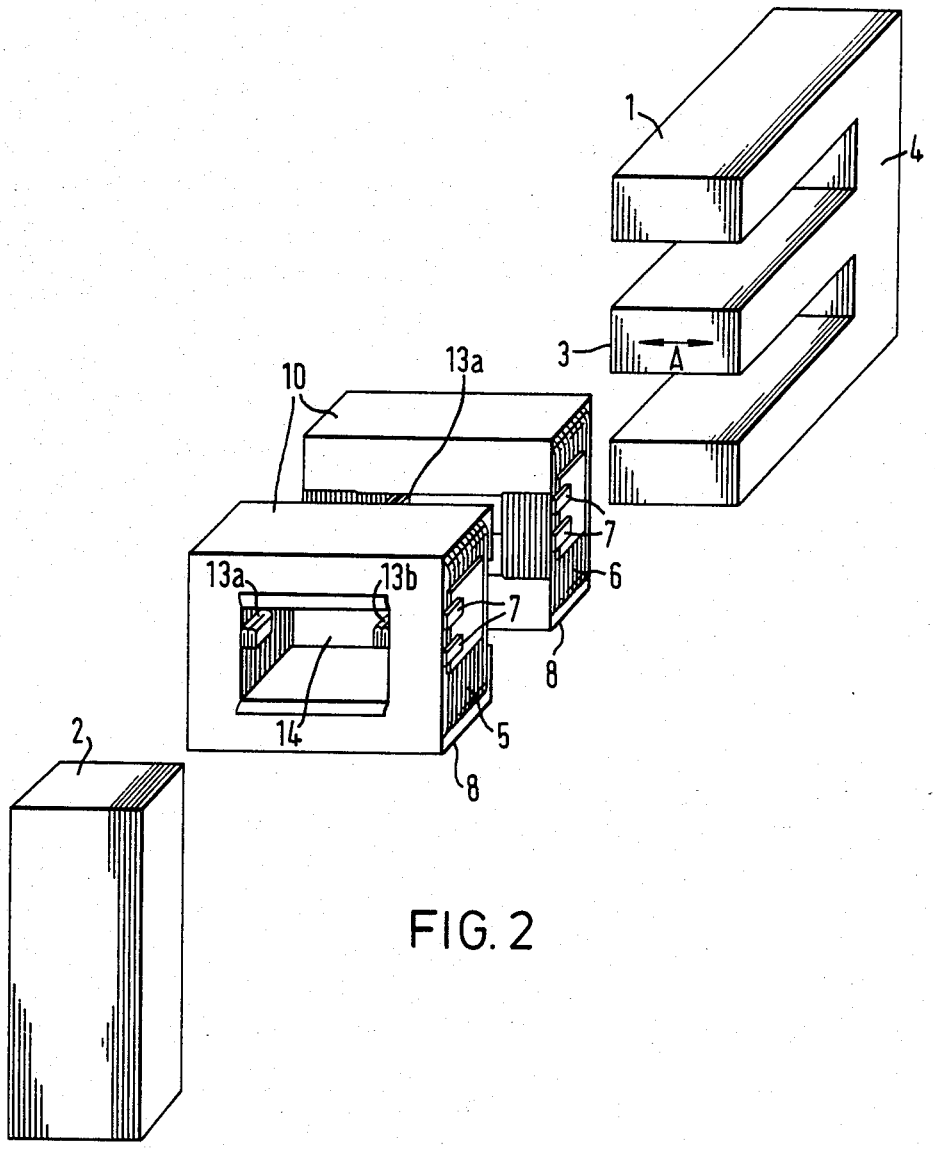
FIG. 2 is an exploded perspective of a transformer of the invention.

Referring now more specifically to the drawings, wherein like reference numerals designate like elements in the several figures, a transformer shown in FIG. 1 and FIG. 2 has an E-shaped magnetic core 1 formed of a stack of E-shaped sheet laminations and an I-shaped magnetic core 2 formed of a stack of I-shaped sheet laminations. The E-shaped core 1 has three parallel legs including an inner or central leg 3 and a heel member 4. The heel member 4 joins each of the three parallel legs transversely at one end thereof, and the legs are unconnected at their opposite ends. Reference numeral 5 is a primary coil, and reference numeral 6 is a secondary coil. The coils each have a pair of electric terminal points 7. The coils 5, 6 are respectively covered with a sheet insulator 8 to insulate the coils from the magnetic cores. One such sheet insulator 8 is illustrated in FIG. 3.

The sheet insulator 8 is made of a single, integrally connected piece of insulating material and includes an opening 9, an upper portion 10, a lower portion 11, and a pair of flap members 12*a*, 12*b* which are formed of integrally connected parts of the sheet insulator 8 in the opening 9. Dotted lines shown in FIG. 3 indicate folding lines. The sheet insulator 8 is made of an aromatic polyamide sheet manufactured by applying a calender process to aramid paper.

When the transformer of the invention is constructed, the sheet insulators 8 are folded along the folding line so that the upper portion 10 and the lower portion 11 are wrapped around the coils. Then the ends of the portion 10, 11 are fixed with adhesive to the coils, respectively. The sheet insulators 8 each cover the coils 5, 6 for insulating the coils from the cores 1, 2 such as shown in FIG. 2. The spacer members 13*a*, 13*b* are formed by the flap members 12*a*, 12*b* as shown in FIGS. 2 and 3 by folding them once horizontally and twice vertically so that they take on an elastic configuration.

Next, the secondary coil 6 is inserted into the E-shaped magnetic core 1, while the spacer members 13*a*, 13*b* are tightly engaged with the secondary coil 6 and the inner leg 3 because of their elastic property.

Then, the primary coil 5 is disposed on the core 1 in the same manner as the secondary coil 6.

Accordingly, when the coils are disposed on the magnetic core, the flap members prevent the coils from shifting, since the coils are disposed with the flap members. These flap members serve as spacer members which maintain the preferable distance between the coils and the inner leg of the E-shaped magnetic core. Further, the spacer members prevent the laminations of the inner leg from expanding thereby preventing noise, because the spacer members bias the laminations of the inner leg by means of their elastic property.

Finally, the I-shaped magnetic core 2 is welded to the legs of the E-shaped magnetic core 1 except for the inner leg 3. The transformer thus constructed is fixed to a base plate 15 by welding.

The spacer members formed of the folded insulator sheet have an elastic property which yields to permit positioning of the central leg of the E-shaped core within the opening 9 while at the same time spacedly secures the core from the coil and bias the laminations of the core to prevent their expansion in the stacking direction, i.e., the direction as indicated by the arrow A in FIG. 2.

While the invention has been described in reference to a preferred embodiment, it will be understood by those skilled in the art that various modifications may be made without departing from the spirit and scope of the invention as set forth in the appended claims.

What is claimed is:

1. A transformer comprising:

an E-shaped magnetic core having three parallel legs including an inner leg and a transversely extending heel member joining each of said legs at one end thereof;

an I-shaped magnetic core disposed in parallel with said heel member at the opposite end of each leg;

a primary coil wound around said inner leg of said E-shaped magnetic core;

a secondary coil wound around said inner leg and disposed adjacent said primary coil;

sheet insulators, made from insulating material, covering each of said primary and secondary coils so that the coils are each insulated from the magnetic cores; and spacer members, each of one-piece construction with each of said sheet insulators and disposed between said coils and said inner leg, for maintaining a desired distance between said coils and said inner leg, each of said spacer members having a portion thereof folded over itself in an accordion-like fashion to provide a bias between the coils and said inner leg.

2. A transformer as recited in claim 1, wherein said sheet insulator has an opening for inserting said inner leg.

3. A transformer as recited in claim 2, wherein said spacer members are formed in said opening by using a pair of flap members of said sheet insulator.

4. A transformer as recited in claim 3, wherein said spacer members are each formed by folding said flap members and constructed by inserting said inner leg into the opening of said sheet insulator.

5. A transformer as recited in claim 4, wherein a single integrally formed sheet insulator covers each of said primary and secondary coils.

6. A transformer as recited in claim 1, wherein said E-shaped core comprises a stack of E-shaped laminations and said I-shaped care comprises a stack of I-shaped laminations, said spacer members securing the laminations forming said inner leg for preventing expansion of same in the stacking direction of said laminations.

* * * * *